US011744355B2

(12) United States Patent
Zhang

(10) Patent No.: US 11,744,355 B2
(45) Date of Patent: Sep. 5, 2023

(54) COSMETIC BRUSH FIXING APPARATUS

(71) Applicant: Shenzhen Tianyuji Technology Co., Ltd., Shenzhen (CN)

(72) Inventor: Bo Zhang, Shenzhen (CN)

(73) Assignee: SHENZHEN TIANYUJI TECHNOLOGY CO., LTD., Shenzhen (CN)

( * ) Notice: Subject to any disclaimer, the term of this patent is extended or adjusted under 35 U.S.C. 154(b) by 478 days.

(21) Appl. No.: 17/019,528

(22) Filed: Sep. 14, 2020

(65) Prior Publication Data

US 2021/0368972 A1 Dec. 2, 2021

(30) Foreign Application Priority Data

May 27, 2020 (CN) ..... 202010462867.4

(51) Int. Cl.
*A46B 5/00* (2006.01)
*A45D 34/04* (2006.01)
*A46B 17/06* (2006.01)

(52) U.S. Cl.
CPC ..... *A46B 5/0095* (2013.01); *A45D 34/042* (2013.01); *A46B 17/06* (2013.01); *A46B 2200/1046* (2013.01)

(58) Field of Classification Search
CPC . A46B 17/06; A46B 17/08; A46B 2200/1046; B08B 11/02
See application file for complete search history.

(56) References Cited

U.S. PATENT DOCUMENTS 6,708,363 B2 * 3/2004 Larsen ..... A61J 17/113 15/210.1
9,974,383 B2 * 5/2018 Hughes, Jr. ..... A46B 17/06
11,485,556 B1 * 11/2022 Brenner ..... A46B 17/02

* cited by examiner

*Primary Examiner* — Shay Karls
(74) *Attorney, Agent, or Firm* — WPAT, P.C

(57) ABSTRACT

A cosmetic brush fixing apparatus includes: an outer tubular body, a fixing ring, and a retainer connecting the outer tubular body with the fixing ring. The fixing ring is connected with a silicone disc which is formed with an insertion opening for mounting a cosmetic brush. A technical key point is that the fixing apparatus is for securing a hand-held part of the cosmetic brush, by using a motor to drive the fixing apparatus to rotate, bristles on the cosmetic brush are driven to rotate, which facilitates the cleaning of the cosmetic brush. By use of cutting grooves formed in the silicone disc, it can adapt to most of cosmetic brushes. Limiting grooves can make a circle center of a cross-section of the cosmetic brush and a circle center of the silicone disc basically coincide with each other when the cosmetic brush is inserted into the silicone disc.

9 Claims, 6 Drawing Sheets

COSMETIC BRUSH FIXING APPARATUS

TECHNICAL FIELD

The invention relates to the field of cosmetic tools, and more particularly to a cosmetic brush fixing apparatus.

DESCRIPTION OF RELATED ART

Modern women's lives are inseparable from cosmetics and cosmetic tools. A full set of cosmetic tools include cosmetic brushes (a set including a lip brush, a blusher brush, an eyebrow brush, an eye shadow brush and so on), a mascara, an eyeliner, an eyebrow pencil, a powder puff, a sponge and so on.

The cosmetic brushes are tools usually used by the modern women; but a long-term use of the cosmetic brushes without washing can easily cause skin allergies, and an improper cleaning of the cosmetic brushes would affect the use. A traditional cleaning method is a direct manual cleaning, which is not easy to clean bristles on the cosmetic brushes.

SUMMARY

Accordingly, an objective of the invention is to overcome the drawback of the prior art and thereby provide a cosmetic brush fixing apparatus.

In order to achieve the above objective, an embodiment of the invention proposes a technical solution as follows.

In particular, a cosmetic brush fixing apparatus includes: an outer tubular body, a fixing ring, and a retainer connecting the outer tubular body with the fixing ring; the fixing ring is connected with a silicone disc, and the silicone disc is formed with an insertion opening for mounting/securing a cosmetic brush.

In a preferred embodiment, two ends of the retainer are respectively arranged into interiors of the outer tubular body and the fixing ring, and the retainer is connected with the outer tubular body and the fixing ring individually.

In a preferred embodiment, an end of the outer tubular body facing away from the fixing ring is disposed with an installation slot, and the installation slot is engaged with a connection block to connect an output shaft of a miniature motor by the connection block.

In a preferred embodiment, the connection block is an integral structure and composed of a rectangular tube, a rotation table and a cylindrical tube; and the rectangular tube fits with the installation slot.

In a preferred embodiment, in a direction from the insertion opening to a peripheral edge of the silicone disc, a plurality of cutting grooves are formed; and each the cutting groove has a length matched with a radius of the cosmetic brush.

In a preferred embodiment, an upper surface of the silicone disc is formed with a plurality of limiting grooves around the insertion opening, and the plurality of limiting grooves are concentrically distributed.

In a preferred embodiment, an outer side of the silicone disc is disposed with a bulging surface, and the bulging surface is convexed outwardly or recessed inwardly relative to the fixing ring.

In a preferred embodiment, the retainer and the outer tubular body are connected in a manner of threaded connection or snap connection, the retainer and the fixing ring are connected in a manner of threaded connection or snap connection.

In a preferred embodiment, the cosmetic brush fixing apparatus further includes another silicone disc connected with the retainer, and thereby the retainer is connected to two ends of the two silicone discs.

In a preferred embodiment, a diameter of the bulging surface of the silicone disc is no smaller than an inner diameter of the fixing ring, and a diameter of the silicone disc is larger than an outer diameter of the fixing ring.

Compared with the prior art, the cosmetic brush fixing apparatus as provided by the invention may have following beneficial effects that:

in an aspect, the whole fixing apparatus is used for securing a hand-held part of the cosmetic brush, by using a miniature motor to drive the whole fixing apparatus to rotate, bristles on the cosmetic brush are driven to rotate correspondingly, which facilitates the cleaning of the cosmetic brush;

in another aspect, when the silicone disc is in use, by use of the cutting grooves formed in the silicone disc, it can adapt to most of cosmetic brushes and facilitate insertion and removing of the cosmetic brush; the limiting grooves can make a circle center of a cross-section of the cosmetic brush and a circle center of the silicone disc be basically coincided with each other when the cosmetic brush inserts into the silicone disc, it can ensure that the whole fixing apparatus can stably drive the cosmetic brush to rotate when rotating and thereby avoiding a large shaking of the cosmetic brush.

Moreover, the whole fixing apparatus can be flexibly disassembled and assembled to facilitate subsequent cleaning of itself.

BRIEF DESCRIPTION OF THE DRAWINGS

In order to more clearly illustrate technical solutions of embodiments of the invention, drawings used in the description of the embodiments will be briefly described below.

Figure 1:
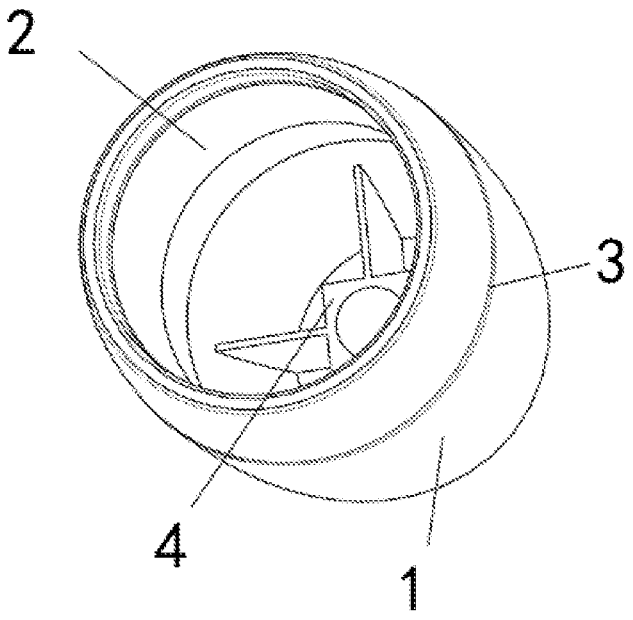
FIG. 1 is a schematic structural view of an outer tubular body, a fixing ring and a retainer, according to an embodiment of the invention.

Numerical references in drawings: 1, outer tubular body; 2, fixing ring; 3, retainer; 4, installation slot; 5, connection block; 6, silicone disc; 7, insertion opening; 8, cutting groove; 9, limiting groove.

DETAILED DESCRIPTION OF EMBODIMENTS

Concrete embodiments of a cosmetic brush fixing apparatus of the invention will be further described below with reference to FIG. 1 and FIG. 2. The cosmetic brush fixing apparatus of the invention is not limited to the description of the following embodiments.

A detailed structure of the cosmetic brush fixing apparatus according to an embodiment of the invention is provided. As illustrated in FIG. 1 through FIG. 8, the cosmetic brush fixing apparatus includes an outer tubular body 1, a fixing ring 2, and a retainer 3 connecting the outer tubular body 1 with the fixing ring 2.

The fixing ring 2 is connected with a silicone disc (also referred to as silicone plate) 6. The silicone disc 6 is formed with an insertion opening (also referred to as socket) 7 for mounting/securing a cosmetic brush. The silicone disc 6 is provided with a raised/protruding bulging surface 61 around the insertion opening 7. The raised bulging surface 61 may increase a holding capacity of the silicone disc 6 to the cosmetic brush. An elastic member 62 is arranged around the bulging surface 61 for fixing the silicone disc 6 relatively stably in the outer tubular body 1 or the fixing ring 2.

The silicone disc 6 may be one installed in the whole structure shown in FIG. 1, as long as it can fix the cosmetic brush. Preferably, in the illustrated embodiment, two silicone discs 6 are used as a preferable embodiment, and their bulging surfaces 61 are arranged outwardly (see FIG. 5), which can hold the cosmetic brush at up and down stages and thus being held firmly. In addition, the two silicone discs may be arranged in a manner of their bulging surfaces 61 facing towards a same direction instead (see FIG. 6).

In order to make the silicone disc is fixed firmly, a diameter of the bulging surface 61 is no smaller than an inner diameter of the fixing ring 2, and a diameter of the silicone disc is larger than an outer diameter of the fixing ring 2.

Figure 7:
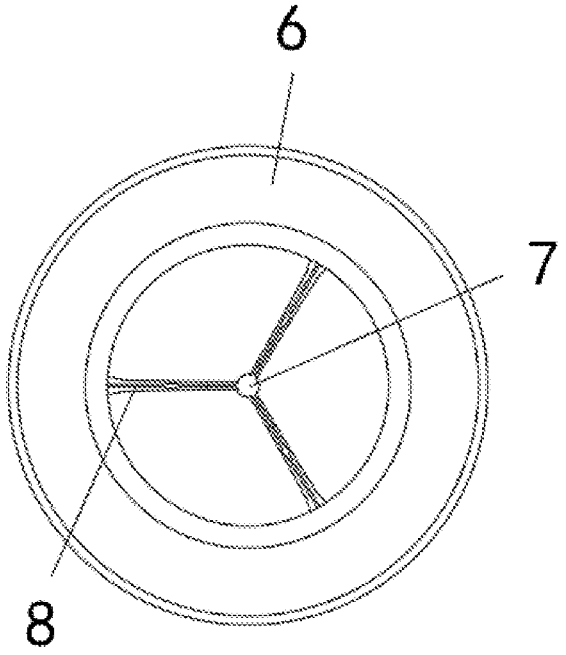
FIG. 7 is a schematic sectional view of an inner side of the silicone disc, according to an embodiment of the invention.
Figure 10:
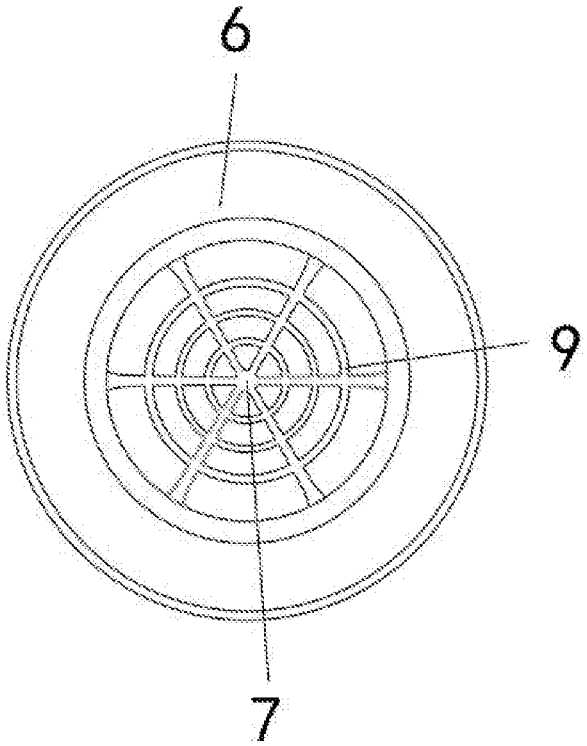
FIG. 10 is a schematic sectional view of an outer side of the silicone disc, according to another embodiment of the invention.

In combination with the illustration of FIG. 7, in a direction from the insertion opening 7 to an edge of the silicone disc 6, there are a plurality of cutting grooves 8 are formed. Each the cutting groove 8 has a length matched with a radius of the cosmetic brush. In other embodiment, the number of the cutting grooves 8 may be four, five or six (as shown in FIG. 10).

When using the silicone disc 6, the cutting grooves 8 formed on the silicone disc 6 can adapt to most of cosmetic brushes and thereby it is convenient to insert and remove the cosmetic brush.

A limiting groove(s) 9 can make a circle center of a cross-section of the cosmetic brush and a circle center of the silicone disc 6 basically coincide with each other when the cosmetic brush is inserted into the silicone disc 6, so as to ensure that the whole fixing apparatus can stably drive the cosmetic brush to rotate when rotating and thereby avoiding a large shaking of the cosmetic brush.

Figure 8:
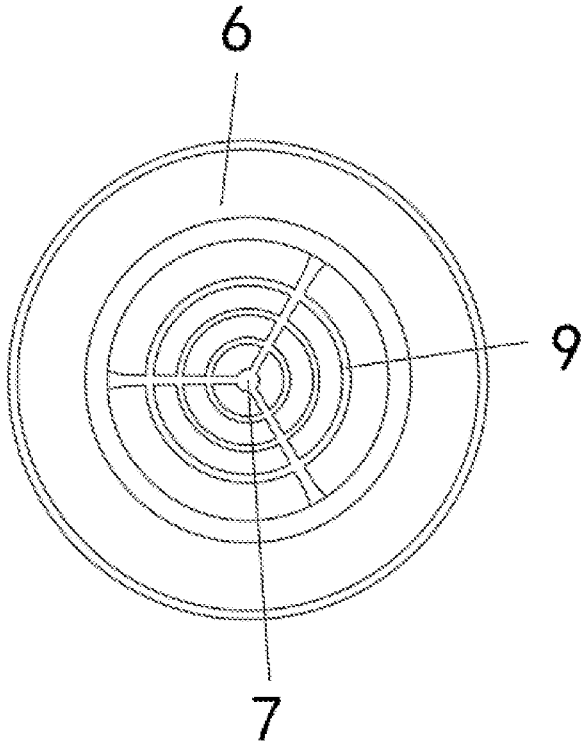
FIG. 8 is a schematic sectional view of an outer side of the silicone disc, according to an embodiment of the invention.

As illustrated in FIG. 8, an upper surface of the silicone disc 6 is provided with a plurality of limiting grooves 9 around the insertion opening 7, and the limiting grooves 9 are distributed in concentric circles, i.e., the limiting grooves 9 are concentrically distributed.

Figure 5:
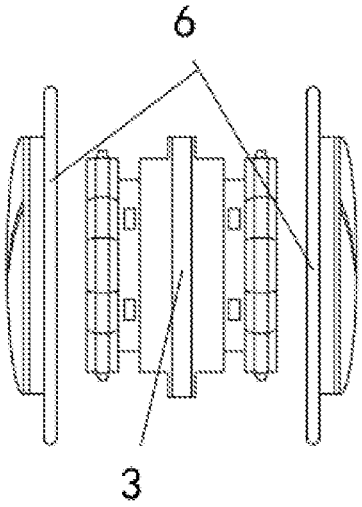
FIG. 5 is a schematic view of assembling the retainer with silicone discs together, according to an embodiment of the invention.
Figure 6:
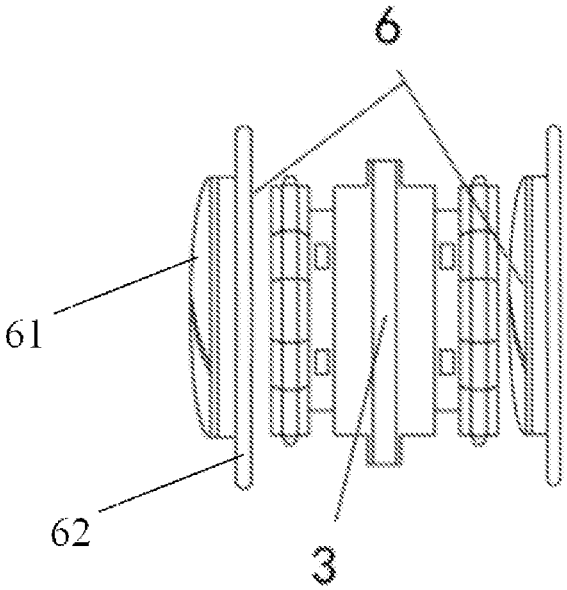
FIG. 6 is another schematic view of assembling the retainer with silicone discs together, according to an embodiment of the invention.

As illustrated in FIG. 5 and FIG. 6, an outer side of the silicone disc 6 is formed with the bulging surface 61, and the bulging surface 61 is convexed outwardly or recessed inwardly relative to the fixing ring 2.

The whole fixing apparatus is for fixing/retaining a handheld part of the cosmetic bush, by using a small motor (not shown, also referred to as miniature motor) to drive the whole fixing apparatus to rotate, and bristles on the cosmetic brush are driven/brought to rotate correspondingly, which facilitates the cleaning operation of the cosmetic brush.

Meanwhile, the whole fixing apparatus can be flexibly disassembled and assembled to facilitate subsequent cleaning of itself.

Figure 3:
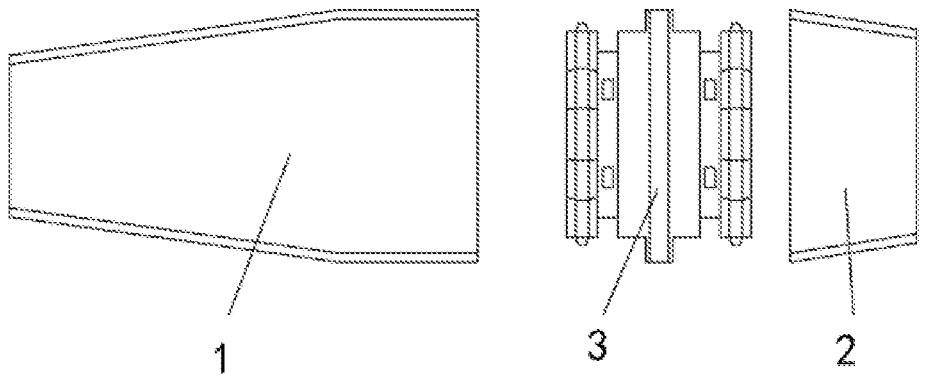
FIG. 3 is a schematic disassembled view of the whole structure shown in FIG. 1, according to an embodiment of the invention.
Figure 4:
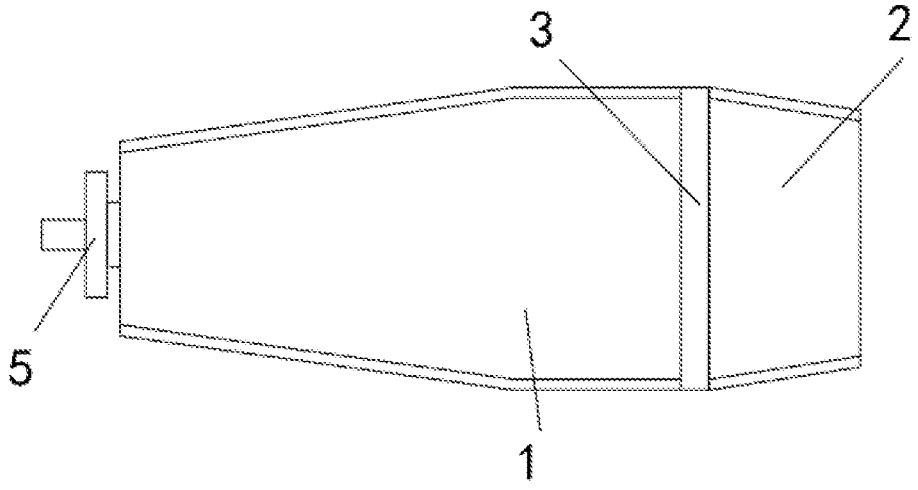
FIG. 4 is a schematic sectional view of the whole structure shown in FIG. 1 after being installed with a connection block, according to an embodiment of the invention.

As illustrated in FIG. 3 and FIG. 4, two ends of the retainer (also referred to as connector) 3 are disposed into the interiors of the outer tubular body 1 and the fixing ring 2 respectively, and the retainer 3 is connected with the outer tubular body 1 and the fixing ring 2 individually.

Figure 2:
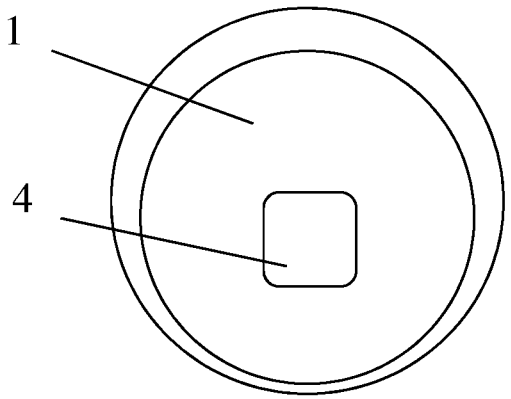
FIG. 2 is a schematic structural view of a side of the outer tubular body disposed with an installation slot, according to an embodiment of the invention.

As illustrated in FIG. 1, FIG. 2 and FIG. 4, an end of the outer tubular body 1 facing away from the fixing ring 2 is disposed with an installation slot 4, and the installation slot 4 is engaged with a connection block 5 to connect an output shaft (not shown) of a small motor by the connection block 5.

In particular, the output shaft of the small motor is connected with a cylindrical tube to drive the whole fixing apparatus to rotate.

As illustrated in FIG. 1, FIG. 2 and FIG. 4, the connection block 5 is an integral structure and composed of a rectangular tube, a rotation table and the cylindrical tube. The rectangular tube fits with the installation slot 4.

Figure 9:
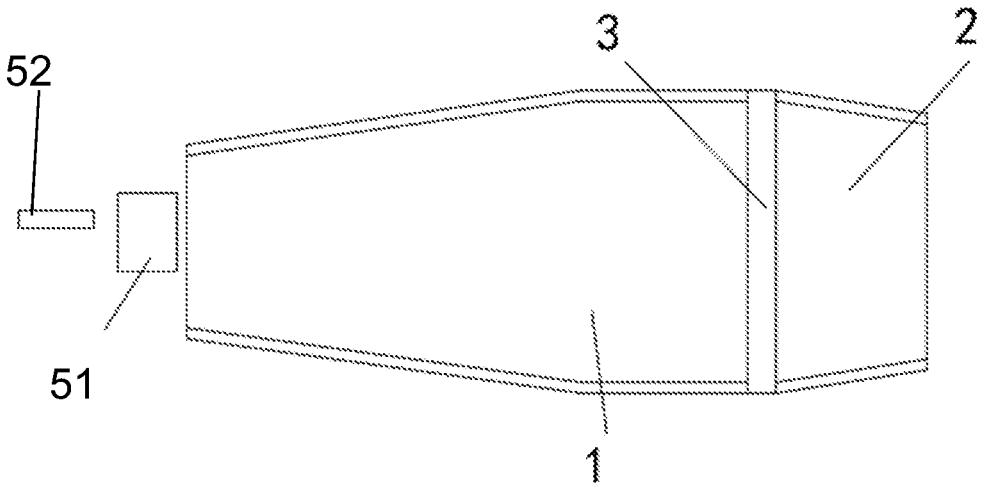
FIG. 9 is a schematic sectional view of the whole structure shown in FIG. 1 after being installed with a connection block, according to another embodiment of the invention

In another embodiment, as illustrated in FIG. 9, the connection block 5 may be composed of a rectangular tube 51 and a cylindrical tube 52, and the cylindrical tube 52 fits with the installation slot 4. Moreover, the rectangular tube 51 may be made of a silicone material and firmly filled into the installation slot 4. The rectangular tube 52 is formed with an insertion hole corresponding to the cylindrical tube 52, an end of the cylindrical tube 52 is inserted into the rectangular tube 51, and another end of the cylindrical tube 52 is configured to connect with the output shaft. Such structure makes the cosmetic brush fixing apparatus rotate more stably.

As illustrated in FIG. 3 and FIG. 4, the retainer 3 and the outer tubular body 1 are connected in a manner of threaded connection or snap connection, the retainer 3 and the fixing ring 2 are connected in a manner of threaded connection or snap connection.

As illustrated in FIG. 5, another silicone disc 6 is connected with the retainer 3, and the retainer 3 is connected to two ends of two silicone discs 6.

The above content is a further detailed description of the invention in combination with concrete preferred embodiments, it cannot be construed as that embodiments of the invention are limited to these descriptions. For those of ordinary skill in the technical field of the invention, without departing from the concept of the invention, some simple deductions or substitutions can be made, which should be regarded as belonging to the protection scope of the invention.

What is claimed is:

1. A cosmetic brush fixing apparatus, comprising: an outer tubular body (1), a fixing ring (2), and a retainer (3) connecting the outer tubular body (1) with the fixing ring (2);

wherein the fixing ring (2) is connected with a silicone disc (6), and the silicone disc (6) is formed with an insertion opening (7) for mounting a cosmetic brush; and wherein the retainer (3) is connected with another silicone disc (6), and thereby the retainer (3) is connected to two ends of two silicone discs (6).

2. The cosmetic brush fixing apparatus as claimed in claim 1, wherein two ends of the retainer (3) are respectively arranged into interiors of the outer tubular body (1) and the fixing ring (2), and the retainer (3) is connected with the outer tubular body (1) and the fixing ring (2) individually.

3. The cosmetic brush fixing apparatus as claimed in claim 2, wherein the retainer (3) and the outer tubular body (1) are connected in a manner of threaded connection or snap connection, and the retainer (3) and the fixing ring (2) are connected in a manner of threaded connection or snap connection.

4. The cosmetic brush fixing apparatus as claimed in claim 1, wherein an end of the outer tubular body (1) facing away from the fixing ring (2) is disposed with an installation slot (4), and the installation slot (4) is engaged with a connection block (5) to connect with an output shaft of a motor by the connection block (5).

5. The cosmetic brush fixing apparatus as claimed in claim 4, wherein the connection block (5) comprises a rectangular tube and a cylindrical tube matched with each other; and the rectangular tube fits with the installation slot (4).

6. The cosmetic brush fixing apparatus as claimed in claim 1, wherein in a direction from the insertion opening (7) to an edge of the silicone disc (6), a plurality of cutting grooves (8) are formed; and a length of each of the plurality of cutting grooves (8) is matched with a radius of the cosmetic brush.

7. The cosmetic brush fixing apparatus as claimed in claim 1, wherein an upper surface of the silicone disc (6) is formed with a plurality of limiting grooves (9) around the insertion opening (7); and the plurality of limiting grooves (9) are concentrically distributed.

8. The cosmetic brush fixing apparatus as claimed in claim 1, wherein an outer side of each of the silicone disc (6) and the another silicone disc (6) is disposed with a bulging surface, and the bulging surface is convexed outwardly or recessed inwardly relative to the fixing ring (2).

9. The cosmetic brush fixing apparatus as claimed in claim 8, wherein a diameter of the bulging surface of the silicone disc (6) is no smaller than an inner diameter of the fixing ring (2), and a diameter of the silicone disc (6) is larger than an outer diameter of the fixing ring (2).

* * * * *